United States Patent [19]

Phung

[11] Patent Number: 4,709,475

[45] Date of Patent: Dec. 1, 1987

[54] COMBINATION COMB, HAIR TRIMMER AND SAFETY RAZOR

[76] Inventor: Ha T. Phung, 3802 Granada Ave., San Diego, Calif. 92104

[21] Appl. No.: 906,020

[22] Filed: Sep. 11, 1986

[51] Int. Cl.[4] ..... B26B 19/00

[52] U.S. Cl. ..... 30/31; 132/76.2

[58] Field of Search ..... 30/31, 30, 55, 77, 90; 132/45 R, 75.3, 75.4, 76.2, 85

[56] References Cited

U.S. PATENT DOCUMENTS

| | | | |
|---|---|---|---|
| 797,184 | 8/1905 | Deneen | 30/31 |
| 1,493,962 | 5/1924 | Cowan | 30/31 |
| 1,536,662 | 5/1925 | Cowan | 30/31 |
| 2,215,877 | 9/1940 | Johnson | 132/76.2 X |

*Primary Examiner*—Paul A. Bell

*Assistant Examiner*—William Fridie, Jr.

*Attorney, Agent, or Firm*—Charles C. Logan, II

[57] ABSTRACT

A combination comb, hair trimmer and safety razor formed from a body member, a cover plate, a handle, and a hair pick attachment. The body member has a plurality of comb teeth formed along its front edge and a recess formed in its top surface along its rear edge for receiving a razor blade. The cover plate can be received in the recess in three different orientations. In one position the device can be used for cutting hair. In a second position the device can be used for trimming hair. In its third position the device can be used as a razor. The handle can be detachably secured to either the right or left side of the body member or additionally at a perpendicular orientation to the body member. The hair pick is detachably stored within a cutout portion in the handle.

12 Claims, 11 Drawing Figures

COMBINATION COMB, HAIR TRIMMER AND SAFETY RAZOR

BACKGROUND OF THE INVENTION

Applicant's novel invention relates to improvements in combination hair cutters and safety razors.

In the past other inventors have designed combined safety razors and hair cutter devices. Some examples of their structure are illustrated in U.S. Pat. No. 797,184, U.S. Pat. No. 1,493,962, and U.S. Pat. No. 1,822,766. The structure of these prior art combination hair cutters and safety razors have had various drawbacks and the applicant has designed a device to overcome these drawbacks. Additionally he has included features not previously available with prior art devices.

It is an object of the invention to provide a novel combination comb, hair trimmer and safety razor having the capability of being used by either a right handed or left handed person.

It is also an object of the invention to provide a novel combination comb, hair trimmer and safety razor that can be used both with or without the handle attachment.

It is another object of the invention to provide a novel combination comb, hair trimmer and safety razor that has a novel hair pick attachment.

It is a further object of the invention to provide a novel combination comb, hair trimmer and safety razor having structure that functions entirely as a comb.

It is an additional object of the invention to provide a novel combination comb, hair trimmer and safety razor that is economical to manufacture and market.

SUMMARY OF THE INVENTION

Applicant's novel combination comb, hair trimmer and safety razor has been designed to be assembled from a minimum number of parts that are easily manufactured. Its design has taken into consideration that fact that some people will be using the device with their right hand while others will be using it with their left hand. It has added features and attachments that have not been previously thought of. Some of its specific features will be discussed below.

Applicant's device has been designed so that the body member can be used solely by itself without the handle attached thereto. It has fingergrip recesses in its lateral side edges to provide for positive gripping by the user. The body is symmetrical so that it can be used either in the right hand or the left hand of the user. The comb portion is always availble for use no matter what attachments are secured thereto. The body member has a ring aperture so that it can be attached to a key ring. The cover plate is capable of being assembled to the body member in four different positions which allows the device to be used for cutting hair, for trimming sideburns and necks, and for shaving. Additionally the device can be used with a standard double edged blade or with a single edged narrow type blade. The magnets on the bottom surface of the cover plate function to attach the razor blade to the bottom surface of the cover plate. The recesses in the bottom surface of the cover plate function to engage the alignment beads extending upwardly from the recess formed in the body member.

The handle can be attached to either of the lateral sides of the body member or its rear end can be screwed onto the top of the threaded stud extending upwardly from the recess formed in the body member. This allows the device to be used as a razor. In this position the handle can be revolved through 360 degrees and locked at any position. Also the hair pick can be removed from the storage position in the cutout portion of the handle and attached to the rear end of the handle when so desired. The hair pick is used to lift hair while grooming it.

DESCRIPTION OF THE PREFERRED EMBODIMENT

Figure 1:
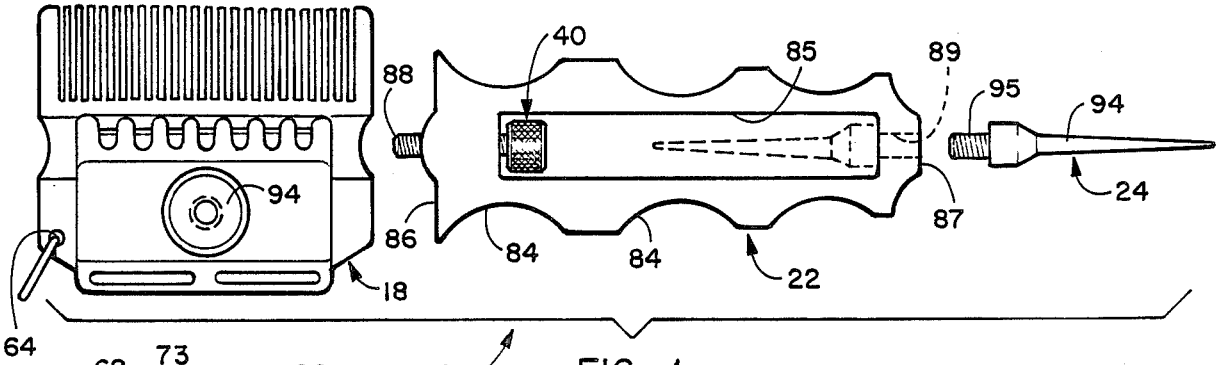
FIG. 1 is an exploded view of applicant's novel combination comb, hair trimmer and safety razor.
Figure 2:
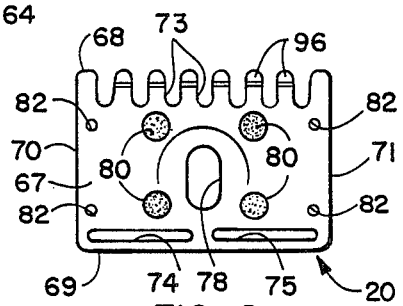
FIG. 2 is a bottom plan view of the cover plate.

Applicant's novel combination comb, hair trimmer and safety razor will now be described by referring to FIGS. 1–11 of the drawing. The novel device is generally designated numeral 16. It has body member 18, a cover plate 20, a handle 22, and a hair pick 24.

Body member 18 has a top surface 26, a bottom surface 27, a front edge 28, a rear edge 29, and lateral side edges 30 and 31. A plurality of comb teeth are formed along front edge 28. Fingergrip recesses 35 and 36 are formed along the respective side edges 30 and 31. Threaded bores 37 and 38 are found in the respective fingergrip recesses 35 and 36.

A substantially rectangularly shaped recess 40 is formed in the top surface 26 of body member 18. Recess 40 has a front edge 41, a rear edge 42, and lateral side edges 43 and 44. An elongated groove 45 is formed the rear edge 42. An externally threaded stud 47 extends upwardly from the bottom surface 48 of the recess 40. A pair of alignment beads 50 an 51 also extend upwardly from the bottom surface of recess 40. If razor blade 54 (See FIG. 6) is used with body member 18, it is positively positioned in its proper place by notches 55 and 56 respectively engaging alignment beads 50 and 51. If razor blade 58 (See FIG. 7) is used, the central portion 59 of the cutout slot of the razor blade slips over threaded stud 47 and alignment beads 50 and 51 are captured in notches 62 and 63. A key ring aperture 64 is also formed in body member 18.

Cover plate 20 has a top surface 66, a bottom surface 67, a front edge 68, a rear edge 69, and lateral side edges 70 and 71. A plurality of fingers 73 are formed along front edge 68. A pair of elongated slots 74 and 75 are formed adjacent rear edge 69. A slot 78 extends from the top surface clear through to the bottom surface of the cover plate 20. A plurality of magnets 80 are recessed in the bottom surface 67 for the purpose of attracting the razor blade. A plurality of alignment recesses 82 are positioned to align with alignment beads 50 and 51 when the cover plate is in either the hair cutting mode or the shaving mode.

Figure 3:
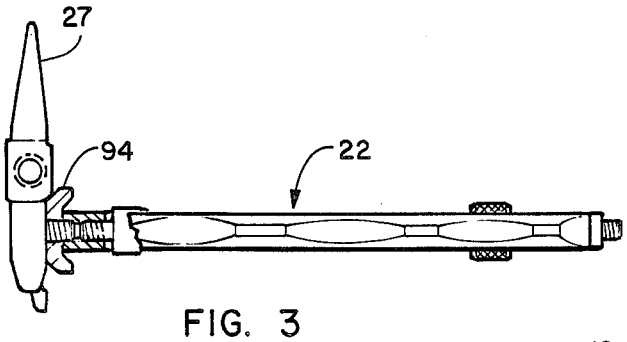
FIG. 3 is a side elevation view illustrating applicant's novel device in the shaving mode and having portions broken away for clarity.
Figure 4:
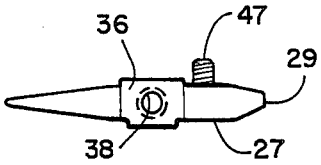
FIG. 4 is a side elevation view of the body member.
Figure 5:
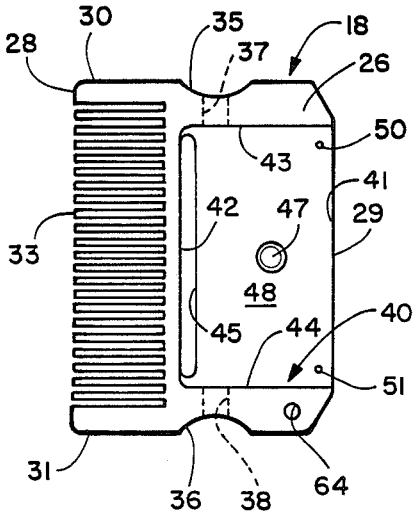
FIG. 5 is a top plan view of the body member.
Figure 6:
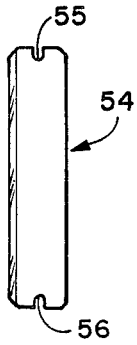
FIG. 6 is a top plan view of one type of a single edge razor blade to be used with applicant's device.
Figure 7:
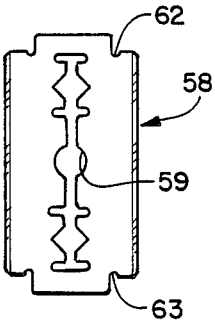
FIG. 7 is top plan view of a double edge razor blade to be used with applicant's novel device.

Handle 22 has finger gripping indentations 84 and a cutout portion 85. It has a front end 86 having a threaded shank portion 88 extending therefrom and it has a rear end 87 having a threaded bore 89 therein. Threaded shank 88 is part of a screw 90 that has a head 91 and which is journaled in handle 22. Hair pick 24 which is used for lifting up portions of the hair has an elongated prong 94 and a threaded shank 95 that is detachably received within threaded bore 89. The phantom lines in FIG. 1 illustrate the hair pick in its stored position which has the threaded shank 95 received in threaded bore 89. It is to be understood that handle 22 can have its threaded shank 88 detachably received in either threaded bore 37 or 38 of body member 18 according to whether the user wishes to hold the device in his left or right hand. In FIG. 3 handle 22 has its threaded bore 89 screwed onto the top end of threaded stud 47. Nut 94 is threaded onto stud 47 in order to hold the cover plate 20 in its desired position in recess 40 of the body member 18.

Figure 8:
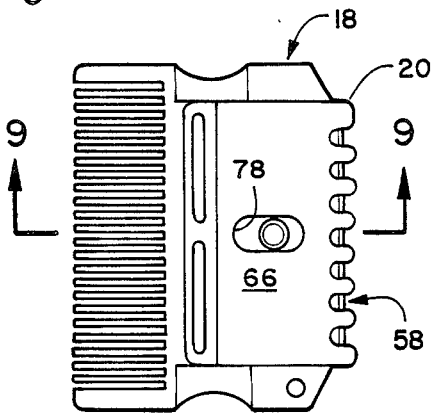
FIG. 8 is a top plan view of the body member showing the cover plate in a hair cutting mode.
Figure 9:
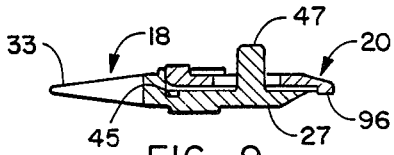
FIG. 9 is a cross-sectional view taken along lines 9—9 of FIG. 8.
Figure 10:
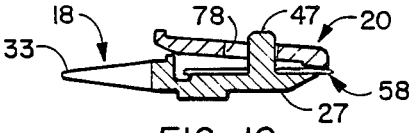
FIG. 10 is a cross-sectional view similar to that of FIG. 9 but showing the cover plate in the hair razor trim mode.
Figure 11:
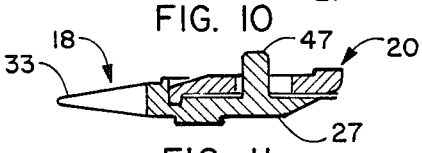
FIG. 11 is a cross-sectional veiw similar to that of FIG. 9 with the cover plate in a shaving mode.

The versatility of applicant's device is illustrated in FIGS. 8–11. In FIGS. 8 and 9, the cover plate is positioned in its hair cutting mode with its fingertips 96 extending downwardly over the front edge of the razor blade. The razor blade 58 is still free to come in contact with portions of the hair that travel into the slots formed between the adjacent fingers 73. Nut 94 would be screwed down upon the top of threaded stud 47 to secure cover plate in its desired position. In FIG. 10 cover plate 20 has been turned over so that its bottom side faces upwardly. By extending the cover plate 20 as far toward the front edge of body member 18 as possible, the razor blade 58 can be used to trim sideburns and portions of the neck. In FIG. 11 cover plate 20 has its direction reversed from its position as illustrated in FIG. 9 and its fingertips 96 nestle into groove 45.

What is claimed is:

1. A combination comb, hair trimmer and safety razor comprising:

a body member having a top surface, a bottom surface, a front edge, a rear edge, and laterally spaced side edges;

a plurality of comb teeth are formed on said body member along its front edge;

a substantially rectangularly shaped recess is formed in the top surface of said body member, said recess having a front edge, a rear edge, and laterally spaced side edges, the front edge of said recess coinciding with the front edge of said body member;

a cover plate having a substantially rectangular shape having a top surface, a bottom surface, a front edge, a rear edge, and laterally spaced side edges, said cover plate being detachably received in the substantially rectangularly shaped recess formed in the top surface of said body member;

said cover plate having a plurality of fingers formed along its front edge, said fingers on said cover plate having downwardly extending finger tips; and means for detachably securing said cover plate to said body member.

2. A combination comb, hair trimmer and safety razor as recited in claim 1 wherein said body member has a substantially rectangular shape.

3. A combination comb, hair trimmer and safety razor as recited in claim 1 further comprising a finger grip indentation formed on each of the side edges of said body member.

4. A combination comb, hair trimmer and safety razor as recited in claim 3 wherein a threaded bore is formed in each of said finer grip indentations for detachably receiving a handle.

5. A combination comb, hair trimmer and safety razor as recited in claim 1 wherein said body member has a ring aperture formed therein for receiving a key chain.

6. A combination comb, hair trimmer and safety razor as recited in claim 1 wherein said means for detachably securing said cover plate to said body member comprises:

an externally threaded stud extending upwardly form the bottom surface of said recess;

a slot in said cover plate through which stud extends; and a nut threaded onto said stud.

7. A combination comb, hair trimmer and safety razor as recited in claim 1 wherein said recess in said body member has a groove formed in its top surface adjacent its rear edge for receiving the finger tips of said cover plate when it is positioned in the shaving mode.

8. A combination comb, hair trimmer and safety razor as recited in claim 1 further comprising a handle and means for detachably attaching it to either of the recesses formed in the lateral sides of said body member.

9. A combination comb, hair trimmer and safety razor as recited in claim 6 further comprising a handled and means for detachably attaching it to said threaded stud.

10. A combination comb, hair trimmer and safety razor comprising:

a body member having a top surface, a bottom surface, a front edge, a rear edge, and laterally spaced side edges;

a plurality of comb teeth are formed on said body member along its front edge;

a substantially rectangularly shaped recess is formed in the top surface of said body member, said recess having a front edge, a rear edge, and laterally spaced side edges, the front edge of said recess coinciding with the front edge of said body member;

a cover plate having a substantially rectangular shape having a top surface, a bottom surface, a front edge, a rear edge and laterally spaced side edges, said cover plate being detachably received in the substantially rectangularly shaped recess formed in the top surface of said body member;

a double edged razor blade captured in the recess formed in the top surface of said body beneath said cover plate, a pair of alignment beads extending upwardly from the top surface of said recess for restricting lateral movement of said razor blade;

at least one magnet mounted in the bottom surface of said cover plate for detachably attracting said razor blade; and means for detachably securing said cover plate to said body member.

11. A combination comb, hair trimmer and safety razor comprising:

a body member having a top surface, a bottom surface, a front edge, a rear edge, and laterally spaced side edges;

a plurality of comb teeth are formed on said body member along its front edge;

a substantially rectangularly shaped recess is formed in the top surface of said body member, said recess having a front edge, a rear edge, and laterally spaced side edges, the front edge of said recess coinciding with the front edge of said body member;

a cover plate having a substantially rectangular shape having a top surface, a bottom surface, a front edge, a rear edge, and laterally spaced side edges, said cover plate being detachably received in the substantially rectangularly shaped recess formed in the top surface of said body member;

an elongated handle and also a hair pick attachment; and means for detachably securing said cover plate to said body member.

12. A combination comb, hair trimmer and safety razor as recited in claim 11 wherein said handle has an elongated cutout slot and means for detachably receiving said hair pick therein.

* * * * *